US012312897B1

(12) United States Patent
Ingraham et al.

(10) Patent No.: US 12,312,897 B1
(45) Date of Patent: May 27, 2025

(54) SUCKER ROD STRIPPER

(71) Applicant: Datwyler Parco Holdings Inc., Wilmington, DE (US)

(72) Inventors: Derek Steve Ingraham, Beasley, TX (US); Shawn Neal Adair, Forney, TX (US); Mayowa Kolawole Mosuro, Houston, TX (US)

(73) Assignee: Datwyler Parco Holdings Inc., Wilmington, DE (US)

( * ) Notice: Subject to any disclaimer, the term of this patent is extended or adjusted under 35 U.S.C. 154(b) by 0 days.

(21) Appl. No.: 18/522,423

(22) Filed: Nov. 29, 2023

(51) Int. Cl.
*E21B 33/08* (2006.01)

(52) U.S. Cl.
CPC ..... *E21B 33/08* (2013.01)

(58) Field of Classification Search
CPC ..... E21B 33/08
See application file for complete search history.

(56) References Cited

U.S. PATENT DOCUMENTS

| | | | | |
|---|---|---|---|---|
| 2,026,036 A | | 12/1935 | Head | |
| 2,079,302 A | * | 5/1937 | Parks | E21B 33/08 277/344 |
| 2,174,366 A | * | 9/1939 | Guiberson | E21B 33/08 277/344 |
| 2,264,600 A | * | 12/1941 | Webb | E21B 33/08 277/344 |
| 2,345,815 A | | 4/1944 | Harroun | |
| 2,685,465 A | * | 8/1954 | Ratigan | E21B 33/08 277/529 |

FOREIGN PATENT DOCUMENTS

| | | | |
|---|---|---|---|
| CN | 201187282 | Y | 1/2009 |
| CN | 201321828 | Y | 10/2009 |
| CN | 104047573 | A | 9/2014 |
| CN | 204941460 | U | 1/2016 |
| CN | 106437621 | A | 2/2017 |
| CN | 108716383 | A | 10/2018 |

OTHER PUBLICATIONS

International Search Report dated Jan. 23, 2025 with Written Opinion for PCT/US2024/056819 filed Nov. 21, 2024.

* cited by examiner

*Primary Examiner* — Brad Harcourt
(74) *Attorney, Agent, or Firm* — Fleit Intellectual Property Law; Paul D. Bianco; Gary S. Winer

(57) ABSTRACT

A sucker rod stripper (1) comprising a housing (2) defining an axial rod passageway (21) therethrough for a sucker rod of an oil well pump, two rubber packings (3, 3'), which are diametrically arranged around the rod passageway (21), each provided with an axial sucker rod groove (31) for stripping the sucker rod, and two radially extending feed screws (4, 4') each extending through a threaded opening (22, 22') in an side wall (24) of the housing (2) and operatively connected to one of the two rubber packings (3, 3') to advance and retract the rubber packing (3, 3') in radial direction within the housing (2), wherein a damping means (5) is arranged between each of the two feed screws (4, 4') and the corresponding rubber packing (3, 3') to allow retraction of the rubber packings (3, 3') when thicker section of a sucker rod passes between the rubber packings (3, 3').

12 Claims, 2 Drawing Sheets

SUCKER ROD STRIPPER

TECHNICAL FIELD

The invention relates to a sucker rod stripper comprising a housing defining an axial rod passageway therethrough for a sucker rod of an oil well pump. The sucker rod stripper is used to remove oil and paraffin from a sucker rod when it is being pulled from the oil well.

TECHNICAL BACKGROUND

A sucker rod stripper is used as oil well equipment to remove oil and paraffin from virtually any size rod or piping as they are being pulled. The stripping action provides a clean and safe work environment which saves time and money during lifting operations.

U.S. Pat. No. 2,345,815 describes to a sucker rod stripper comprising a housing and two diametrically arranged wipers. The wipers are operatively connected to feed screws for advancing and retracting the wipers. A compression is placed between the housing and the wiper to force the wipers in the direction of the sucker rod when closing advancing the wipers. When pulling the sucker rod from the oil well the wipers have to be manually retracted at each wider portion, i.e. rod connections or centralizers. CN104047573 describes a similar device with six rubber packings.

When using such a sucker rod stripper (SRS) to install and pull sucker rods one has to manually thread in the rubber packings to provide stripping action. When you come to a connection of rod parts or a centralizer the rubber packing is stretched more than normal due to the increase in diameter. In many cases the centralizer will not fit through the rubber packings and the operator has to unscrew the sucker rod stripper to allow for the centralizer to come through. Pulling the rod connections and centralizers through the sucker rod stripper without unscrewing the sucker rod stripper will cause the rubber to prematurely fail. Having to unscrew and re-screw the sucker rod stripper to allow passage of the centralizers causes extra time for the operator.

An older version of a sucker rod stripper is disclosed in U.S. Pat. No. 2,026,036. The sucker rod stripper has several spring-loaded wipers each provided with a through hole for the sucker rod. The wipers are arranged next to each other in axial direction of the sucker rod and may be moved from an open position to a closed position. At each wider portion of the sucker rod, the wipers may be manually brought into the open position let the wider portion pass. The device has a complex setup leading to elaborate and expensive maintenance and cleaning.

CN106437621 discloses a similar sucker rod cleaning device with a nylon scraping block connected to a housing via a cushion spring. Pressure of the scraping block against the sucker rod cannot be adjusted. The problem when pulling wider parts through the device is not addressed.

CN201187282 discloses a sucker rod oil scraper with automatic adjustment when the scraper rubber is worn. The device comprises two scraper rubbers arranged next to each other in axial direction. The scraper rubber is attached to a compression spring to automatically correct wear of the scraper rubber. The spring is attached to a screw plug to adjust the elastic force of the spring. A disadvantage is, that the eccentric positioning of the wipers leads to a torque force onto the sucker rod. Also, the scraped of oil is directed through the device and flows out of a drain hole. Therefore, the compression spring is in contact with the oil. Maintenance and cleaning of the device is often required and therefore elaborate and expensive.

SUMMARY OF THE INVENTION

It is an objective of the invention to solve the problems of the prior art and to provide a sucker rod stripper which is robust and needs little maintenance. At least one of the objectives of the present invention is achieved by the sucker rod stripper according to claim 1.

The sucker rod stripper comprises a housing defining an axial rod passageway therethrough for a sucker rod of an oil well pump, two rubber packings, which are diametrically arranged around the rod passageway, each provided with an axial sucker rod groove for stripping the sucker rod, and two radially extending feed screws each extending through a threaded opening in an outer wall of the housing and operatively connected to one of the two rubber packings to advance and retract the rubber packing in radial direction within the housing. A damping means is arranged between each of the two feed screws and the corresponding rubber packing to allow retraction of the rubber packings when a thicker section of a sucker rod passes between the rubber packings.

The sucker rod stripper may be installed around a sucker rod to remove oil and paraffin from the rod as it is being pulled. Thereby the sucker rod passes in axial direction through the passageway defined by the housing and the rubber packings. In operation, the diametrically arranged rubber packings are advanced towards the rod in radial direction by operating the feed screws, such that the rubber packings abut from both side against the sucker rod. When the sucker rod is pulled, wider portions such as rod connections or centralizers are pulled passed the rubber packings and push them radially outwards against the force of the damping means, thereby enlarging the passageway. As soon as the wider section has passed, the damping means push the rubber packings radially inwards to reduce the size of the passageway to fit with the sucker rod. Thus, the sucker rod stripper is automatically adjusted to the section size of the sucker rod without operating the feed screws. To remove the sucker rod stripper, the rubber packings are retracted away from the sucker rod by operating the feed screws.

Further embodiments of the invention are set forth in the dependent claims.

In some embodiments the sucker rod stripper may further comprise two follower plates each abutting to one of the rubber packings and being releasably connected to the damping means. The follower plates may have a guiding groove fitting a complementary radial guiding rib within the housing. The follower plates distribute the force originating from the feed screw and the damping means over a large surface of the rubber packings. The rubber packings may be attached to the follower plates.

In some embodiments the damping means may comprise a compression spring.

In some embodiments the damping means may further comprise a feed rod connected with a first end to the compression spring and with an opposite second end to the rubber packing.

In some embodiments the compression spring may be entirely arranged in a blind hole of the feed screw and the feed rod is partially arranged in the blind hole. The feed rod may have a guiding section between the first end and second end having a diameter fitting in the blind hole in a sliding manner. Therefore, the outer diameter of the guiding section is slightly smaller than the inner diameter of the blind hole.

The guiding section may be sealed towards an inner wall of the screw to protect the compression spring from stripped debris. The feed rod may have an annular shoulder between the guiding section and the first end, and the compression spring may fit around the first end and abut against the shoulder.

In some embodiments the second end of the feed rod and the follower plate may be provided with interlocking means for releasably attaching the second end of the feed rod to the follower plate. The interlocking means may be designed in a manner to be able to advance and retract the follower plate.

In some embodiments the feed screw may be provided with a crank or handle at its outer end for feeding the feed screw radially inwards or outwards and thereby advancing or retracting the rubber packings within the housing.

In some embodiments the axial sucker rod groove has a semi-circular cross section with a tapered enlargement at both ends. The sucker rod grooves of the two rubber packings form together a conical opening. When a widened section of the sucker rod passes, the rubber packings are more easily pushed radially outwards against the force of the damping means.

In some embodiments the housing comprises two lateral extensions diametrically arranged around the rod passageway and defining a movement space for the rubber packings and optionally the follower plates.

BRIEF EXPLANATION OF THE FIGURES

The invention is described in greater detail below with reference to embodiments that are illustrated in the figures. The figures show.

EMBODIMENTS OF THE INVENTION

Figure 1:
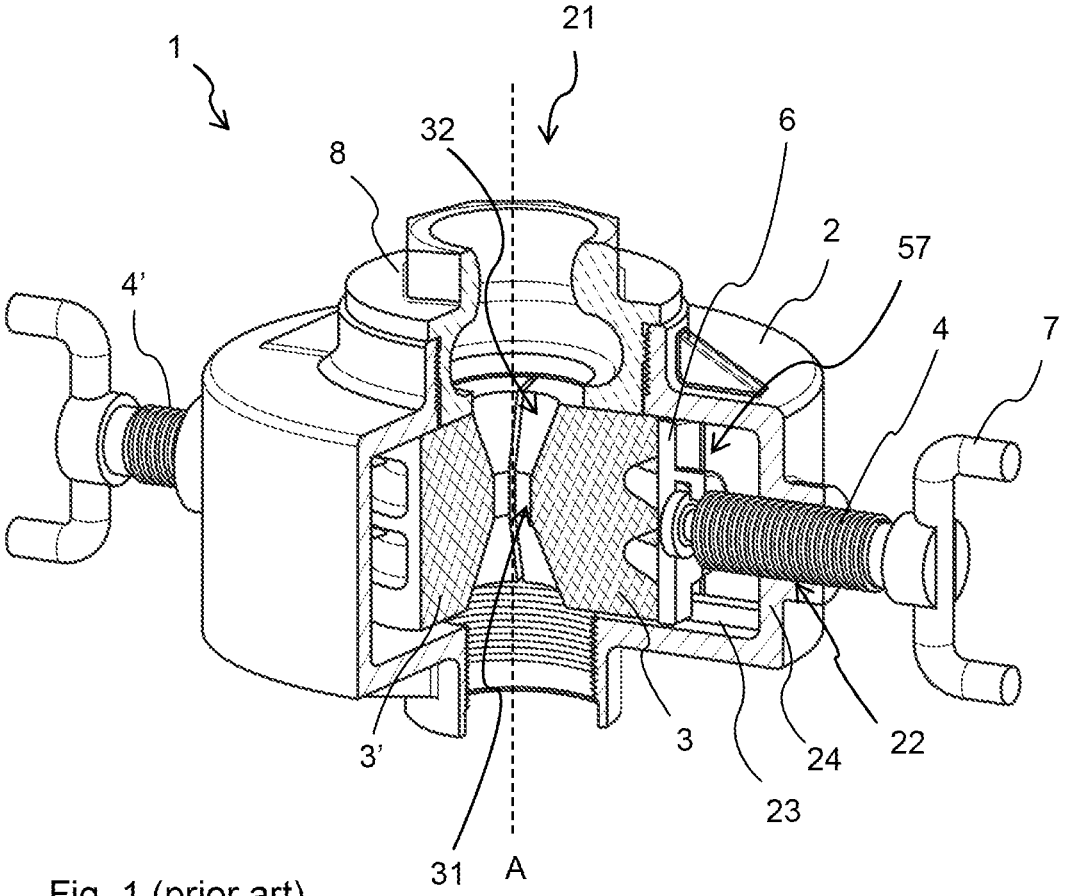
Fig. 1 (prior art)
FIG. 1 a perspective view of a sucker rod stripper as known.

FIG. 1 shows a perspective view of a sucker rod stripper 1 as known. The sucker rod stripper 1 comprises a housing 2 accommodating two rubber packings 3, 3' and two follower plates 6, 6' connected to the rubber packings 3, 3'. The housing 2 and the rubber packings 3, 3' define a passageway 21 for a sucker rod in axial direction A. The rubber packings 3, 3' and the follower plates 6, 6' are diametrically arranged around the axial passageway 21 and slidably arranged within respective movements spaces 23, 23' of the housing 2.

The sucker rod stripper 1 further comprises two feed screws 4, 4', which are operatively connected to the rubber packings 3, 3' and extend through threaded openings 22, 22' in a side wall 24 of the housing 2.

The rubber packings 3, 3' may be advanced and retracted by operating the feed screws 4, 4'. For easier operation, the feed screws may be provided with a crank or handle 7 at its outer end 42. In a closed position for stripping, the rubber packings 3, 3' are in an advanced position and abut against the sucker rod. To firmly fit the rubber packings 3, 3' around the sucker rod, the rubber packings 3, 3' are each provide with an axial sucker rod groove 31 with a semi-circular cross section.

The housing 2 may comprise a cap 8, which may be screwed at one side of the passageway 21 into the housing 2. The cap 8 also has an opening, which defines the passageway 21 for the sucker rod. The cap 8 may be unscrewed to enlarge the passageway 21 in the housing 2 to replace the rubber packings 3, 3'.

Figure 2:
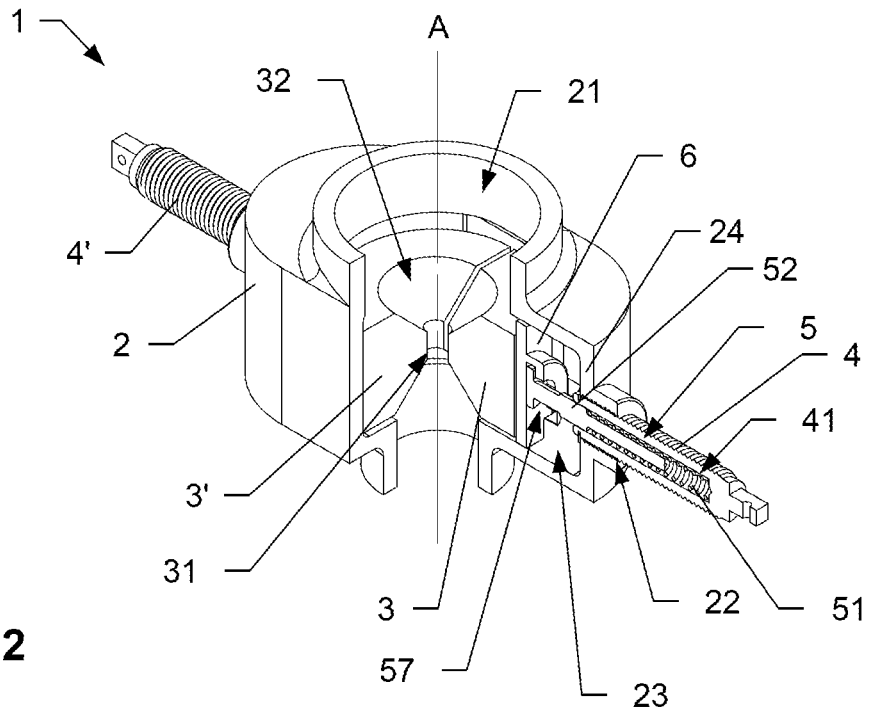
FIG. 2 a perspective view of a sucker rod stripper without handle and cap.
Figure 3:
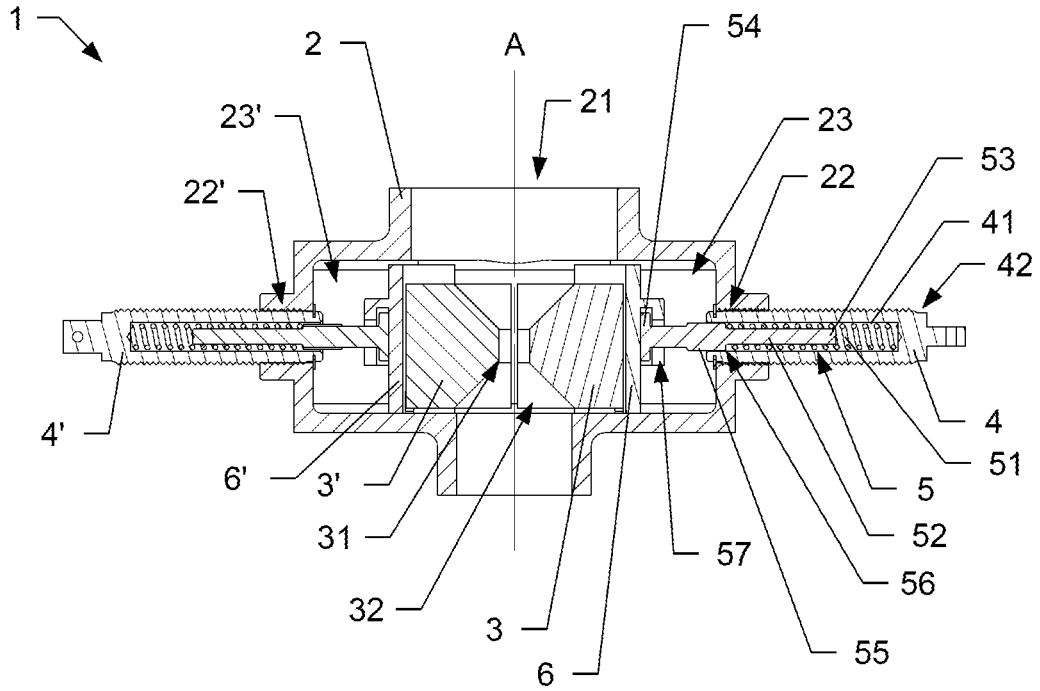
FIG. 3 a cross section of the sucker rod stripper of FIG. 1.

FIG. 2 shows a perspective view and FIG. 3 shows a cross section view of a sucker rod stripper 1 further comprising two resilient damping means 5, 5' arranged between the feed screws 4, 4' and the corresponding rubber packings 3, 3'. The damping means allow an automatic outward movement of the rubber packings 3, 3' when a wider section of the sucker rod is pulled through the passageway 21. After the wider section has passed the rubber packings 3, 3', the rubber packings 3, 3' are pressed back to the closed position by the damping means. To facilitate the opening of the passageway 21 when a wider section passes, each sucker rod groove 31 may have a tapered enlargement 32 at both sides. The two rubber packings thus form conical openings on both sides of the passageway 21.

The damping means in the shown embodiment comprises a compression spring 51 and a feed rod 52 inserted with a first end 53 into the compression spring 51 and releasably connected to the follower plates 6, 6' via interlocking means 57 at a second end 54 of the feed rod 52. The feed rod 52 further comprises a guiding section 55 between its first end 53 and second end 54. The guiding section 55 is wider than the first end 53 and forms a annular shoulder 56 against which the compression spring 51 abuts.

The compression spring 51 is entirely accommodated within a blind hole 41 of the feed screw 4, 4'. The guiding section 55 of the feed rod 52 is at least partially accommodated in a sliding manner within the blind hole 41 of the feed screw 4. Therefore, the outer diameter of the guiding section 55 is slightly smaller than the inner diameter of the blind hole 41.

REFERENCE SIGNS

1 sucker rod stripper
2 housing
21 axial rod passageway
22, 22' threaded opening
23 extensions/movement space
24 side wall
3, 3' rubber packing
31 sucker rod groove
32 tapered enlargement
4, 4' feed screw
41 blind hole
42 outer end
5 damping means
51 compression spring
52 feed rod
53 first end
54 second end
55 guiding section
56 annular shoulder
57 interlocking means
6,6' follower plate
7 crank/handle
8 cap
A axial direction

The invention claimed is:

1. A sucker rod stripper comprising a housing defining an axial rod passageway therethrough for a sucker rod of an oil well pump, two rubber packings, which are diametrically arranged around the rod passageway, each of the two rubber packings provided with an axial sucker rod groove for stripping the sucker rod, and two radially extending feed screws each extending through a threaded opening in an side wall of the housing and operatively connected to one of the two rubber packings to advance and retract the rubber packing in radial direction within the housing, wherein a damping element is arranged between each of the two feed screws and the corresponding rubber packing to allow retraction of the rubber packings when a thicker section of a sucker rod passes between the rubber packings, wherein the damping element comprises a compression spring and a feed rod with a first end connected to the compression spring, and wherein the compression spring is entirely arranged in a blind hole of the feed screw and the feed rod is partially arranged in the blind hole.

2. The sucker rod stripper according to claim 1, wherein the sucker rod stripper further comprises two follower plates each abutting to one of the rubber packings and being releasably connected to the damping element.

3. The sucker rod stripper according to claim 1, wherein the feed rod has a guiding section between the first end and a second end having a diameter fitting in the blind hole in a sliding manner.

4. The sucker rod stripper according to claim 3, wherein the feed rod has an annular shoulder between the guiding section and the first end, and the compression spring fits around the first end and abuts against the shoulder.

5. The sucker rod stripper according to claim 1, wherein the sucker rod stripper further comprises two follower plates each abutting to one of the rubber packings and being releasably connected to the damping element and wherein the second end of the feed rod and the follower plate are provided with interlocking means for releasably attaching the second end of the feed rod to the follower plate.

6. The sucker rod stripper according to claim 1, wherein the feed screw is provided with a crank or handle at an outer end for feeding the feed screw radially inwards or outwards and thereby advancing and retracting the rubber packings within the housing.

7. The sucker rod stripper according to claim 1, wherein the axial sucker rod groove has a semi-circular cross section with a tapered enlargement at both ends.

8. The sucker rod stripper according to claim 1, wherein the housing comprises two lateral extensions diametrically arranged around the rod passageway and defining a movement space for the rubber packings.

9. The sucker rod stripper according to claim 1, wherein the sucker rod stripper further comprises two follower plates each abutting to one of the rubber packings and being releasably connected to the damping element and wherein the housing comprises two lateral extensions diametrically arranged around the rod passageway and defining a movement space for the follower plates.

10. A sucker rod stripper comprising a housing defining an axial rod passageway therethrough for a sucker rod of an oil well pump, two rubber packings, which are diametrically arranged around the rod passageway, each of the two rubber packings provided with an axial sucker rod groove for stripping the sucker rod, and two radially extending feed screws each extending through a threaded opening in an side wall of the housing and operatively connected to one of the two rubber packings to advance and retract the rubber packing in radial direction within the housing, wherein a damping element is arranged between each of the two feed screws and the corresponding rubber packing to allow retraction of the rubber packings when a thicker section of a sucker rod passes between the rubber packings, wherein the sucker rod stripper further comprises two follower plates each abutting to one of the rubber packings and being releasably connected to the damping element, wherein the damping element further comprises a compression spring and a feed rod with a first end connected to the compression spring and an opposite second end connected to the rubber packing or the follower plate, and wherein the compression spring is entirely arranged in a blind hole of the feed screw and the feed rod is partially arranged in the blind hole.

11. The sucker rod stripper according to claim 10, wherein the feed rod has a guiding section between the first end and the second end having a diameter fitting in the blind hole in a sliding manner.

12. The sucker rod stripper according to claim 11, wherein the feed rod has an annular shoulder between the guiding section and the first end, and the compression spring fits around the first end and abuts against the shoulder.

* * * * *